US005328338A

United States Patent [19]

Hirano et al.

[11] Patent Number: 5,328,338

[45] Date of Patent: Jul. 12, 1994

[54] HERMETICALLY SEALED ELECTRIC MOTOR COMPRESSOR

[75] Inventors: Yutaka Hirano; Hirokazu Kawakami, both of Ohta; Ryuji Watanabe; Kiyoshi Tanaka, both of Ohra; Hiroshi Takagi, Isesaki, all of Japan

[73] Assignee: Sanyo Electric Co., Ltd., Moriguchi, Japan

[21] Appl. No.: 22,696

[22] Filed: Mar. 1, 1993

[51] Int. Cl.[5] ..... F04B 21/02

[52] U.S. Cl. ..... 417/312; 417/565; 417/569; 181/403; 137/527

[58] Field of Search ..... 417/312, 565, 569; 137/856, 527, 855; 181/403

[56] References Cited

U.S. PATENT DOCUMENTS

| | | | |
|---|---|---|---|
| 4,573,880 | 3/1986 | Hirano et al. | 181/403 |
| 4,714,416 | 12/1987 | Sano | 137/856 |
| 4,723,896 | 2/1988 | Fritchman | 417/571 |
| 4,764,091 | 8/1988 | Ikeda | 137/855 |
| 4,813,852 | 3/1989 | Ikeda | 417/312 |
| 4,978,285 | 12/1990 | Da Costa | 417/569 |
| 5,110,272 | 5/1992 | Peruzzi et al. | 137/856 |
| 5,178,183 | 1/1993 | Kim | 417/569 |
| 5,209,260 | 5/1993 | Baek | 417/569 |

FOREIGN PATENT DOCUMENTS

| | | | |
|---|---|---|---|
| 60-32156 | 8/1986 | Japan | 417/312 |

*Primary Examiner*—Richard A. Bertsch
*Assistant Examiner*—Peter Korytnyk
*Attorney, Agent, or Firm*—Darby & Darby

[57] ABSTRACT

A hermetically sealed electric motor compressor, comprising a hermetically sealed casing, a reciprocating compressor unit mounted within the casing and compressing a working fluid, the compressor unit having a first discharge passageway, a valve assembly mounted within the casing and opening and closing the first discharge passageway, the valve assembly having a second discharge passageway, a discharge port mounted to the second discharge passageway within the casing and including a muffler. The muffler defines a plurality of resonance chambers. The discharge port includes a base plate having a projection. The valve assembly includes a reed valve assembly including a reed valve and a valve backer mounted behind the reed valve. The valve assembly includes a valve seat defining a recess receiving the reed valve assembly, and an elastic gasket and a holder elastically holding an end of the reed valve assembly within the recess so that the projection of the base plate pushes the end of the reed valve assembly on the bottom of the recess by means of the gasket. The valve backer limits the degree of opening of the reed valve and accelerates the return speed of the reed valve.

5 Claims, 15 Drawing Sheets

FIG.18(A)
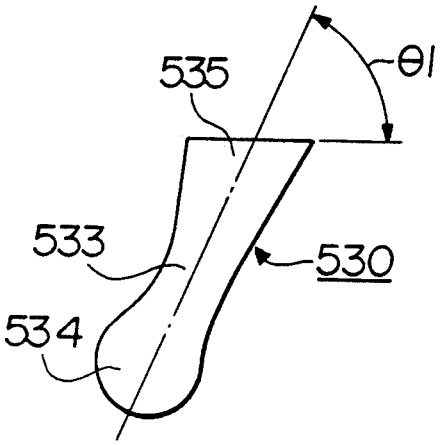
FIG.18(B)
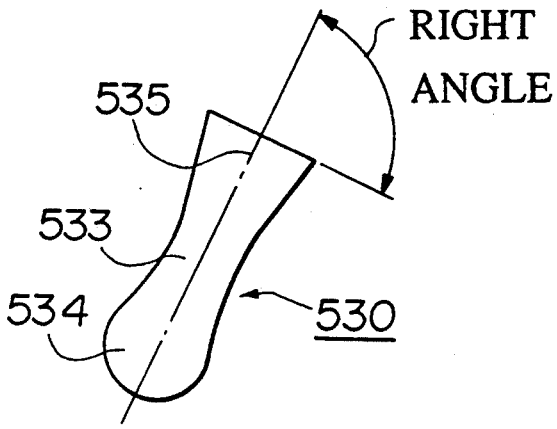
FIG.18 (C)
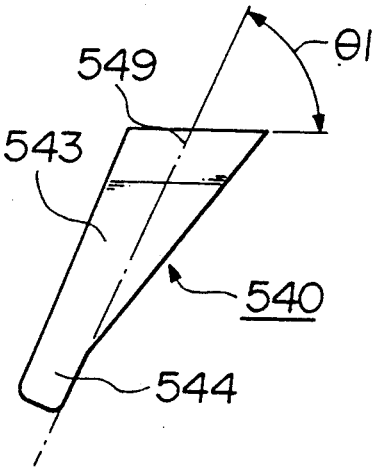
FIG.18 (D)
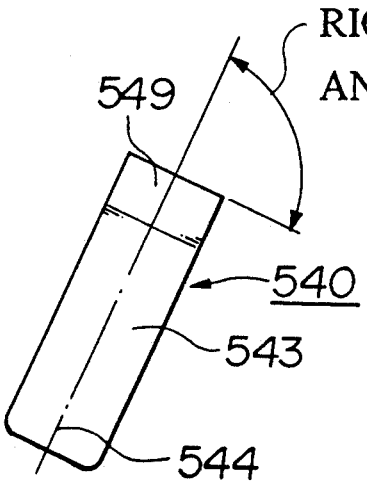
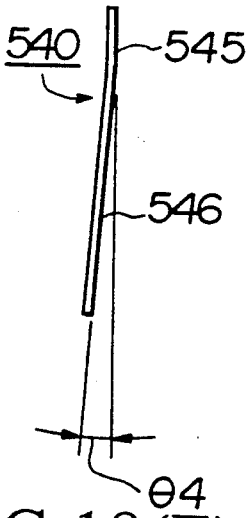
FIG.18(E)

HERMETICALLY SEALED ELECTRIC MOTOR COMPRESSOR

BACKGROUND OF THE INVENTION

1. Field of the Invention

The present invention relates to hermetically sealed electric motor compressors for use in household refrigerators, e.g., and more particularly to hermetically sealed electric motor compressors having an improved valve assembly opening and closing a discharge port of a compressor unit and an improved muffler mounted to the discharge port of the compressor unit.

2. Background Art

FIG. 1 is a block diagram illustrative of the arrangement of the components of the of such compressor 1000. The hermetically sealed electric motor compressor 1000 comprises an electric power supply unit 100 receiving electric power from the outside of the compressor 1000, an electric motor 200 receiving electric power from the electric power supply unit 100, a reciprocating compressor unit 300 driven by the electric motor 200, a suction port unit 600 and a discharge port unit 700 which communicate with the interior of the reciprocating compressor unit 300 through a valve assembly 500 mounted to the reciprocating compressor unit 300. The suction port unit 600 has a suction passageway 601. The discharge port unit 700 has a discharge passageway 701. The reciprocating compressor unit 300 sucks refrigerant, e.g., freon through the suction port unit 600 and the valve assembly 500, and compresses and discharges said refrigerant through the valve assembly 500 and the discharge port unit 700. The compressor 1000 further comprises a hermetically sealed casing 900 and a resilient support 800 supporting the electric motor 200, the reciprocating compressor unit 300, the valve assembly 500, the suction port unit 600 and the discharge port unit 700 on the interior surface of the casing 900. The compressor 1000 further comprises a self-lubricating system 400 comprising an oil reservoir. The oil reservoir is mounted on the bottom of the casing 900 and holds lubricating oil 401. The self-lubricating system 400 circulates lubricating oil 401 through mechanically moving parts of the motor 200 and the reciprocating compressor unit 300.

Detailed descriptions of the structures and the operations of the parts described above of the compressor 1000 (referred to as a first prior art hereinafter) are disclosed in U.S. Pat. No. 4,573,880 corresponding to an aggregation of Japanese examined patent application publication SHO. 62-30311, Japanese examined patent application publication HEI. 4-48944 and Japanese examined patent application publication HEI. 4-48945. The disclosure of U.S. Pat. No. 4,573,880 is incorporated herein by the reference thereto.

Since the frequency of reciprocation of the piston of the reciprocating compressor unit 300 is as high-speed as 3,000 times/min, a muffler mounted to the discharge port unit 700 and the structure of the valve assembly 500 have required various improvements.

The first prior art discloses a structure in which a discharge port unit 700 having a muffler comprising, e.g., a series of resonance chambers having different sizes increases an effect of noise reduction.

On the other hand, Japanese examined utility model application publication HEI. 2-25986 discloses the structure of a second prior art in which a valve assembly comprises a reed valve opening and closing a discharge port, and a restraining thick plate mounted behind the reed valve and having sufficient angle of opening so as to restrain the degree of opening of the reed valve and accelerate a return speed of the reed valve to increase the compression efficiency of the reciprocating compressor unit. U.S. Pat. No. 4,723,896 discloses a structure of a third prior art in which a valve assembly comprises a reed valve opening and closing a discharge port, and a restraining plate assembly of leaf springs superposed and disposed in a recess defined in a valve seat behind the reed valve and the restraining plate assembly covers an approximately half of the operating portion of the reed valve covering the discharge port so that the reed valve is twisted to open the discharge port and direct discharged fluid along the axis of the discharge port and so that the torsion from the twisted reed valve accelerates the closing speed of the reed valve.

Since in the valve assemblies of the second and third prior arts simple bending stress and torsional stress in the reed valve assembly of the reed valve and the valve backer return the reed valve to the closed position, the closing speed and the closing force of the reed valve are insufficient so that the reed valve cannot sufficiently follow the discharge pressure of refrigerant and a counterpressure alternating at a high speed to sufficiently reduce the volume of refrigerant returned to the discharge hole. Thus a compressor having the valve assembly of the second or third prior art cannot achieve a sufficient performance of compression.

In addition, since the discharge port having the muffler of the first prior art produces a high pressure at the inlets of the resonance chambers to produce a high discharge resistance when the fluid is discharged from a shut-off valve of the valve assembly, this discharge resistance degrades the compression efficiency and causes the muffler to insufficiently deaden noise.

SUMMARY OF THE INVENTION

A primary object of the present invention is to provide a hermetically sealed electric motor compressor which eliminates a drawback in the second and third prior art valve assemblies to increase the performance of compression.

A further object of the present invention is to provide a hermetically sealed electric motor compressor which eliminates a drawback in the first prior art discharge port unit to increase the compression efficiency and an effect of noise reduction.

In order to achieve the objects, in a hermetically sealed electric motor compressor of the present invention comprising a hermetically sealed casing within which a reciprocating compressor unit having a discharge port and compressing a working fluid, a valve assembly opening and closing the discharge port, and a discharge port unit mounted to the discharge side of the valve assembly are provided, said discharge port unit including a muffler which comprises a plurality of resonance chambers, and further including a base plate having a projection; a first improvement of the hermetically sealed electric motor compressor is concerned in a construction of a valve assembly 500, wherein the valve assembly includes a reed valve assembly including a reed valve and a valve backer mounted behind the reed valve, a valve seat defining a recess receiving said reed valve assembly, an elastic gasket having portions for elastically holding an end of the reed valve assembly within the recess so that the projection of the base plate of the discharge port unit pushes the end of the reed valve assembly on the recess via the elastic portions of the gasket. In the structure of the valve assembly, the elastically of both of the valve backer and the gasket restrains the opening of the reed valve and accelerates the closing of the reed valve to improve the performance of compression.

In the hermetically sealed electric motor compressor of the present invention, a second improvement thereof is concerned in defining the configurations of the reed valve and the valve backer of the above-described reed valve assembly. The reed valve may include an end which is elastically held as the above-described and includes opposite fulcrums projecting laterally of the reed valve, an intermediate portion extending from said end obliquely to a straight line joining the opposite fulcrums, and an operating end adjoined to the front end of the intermediate portion opening and closing the discharge port. The valve backer may include an end having substantially the same shape as the end of the reed valve, an intermediate portion extending from the end of the valve backer in the same direction as the intermediate portion of the reed valve, a front end adjoined to the front end of the intermediate portion. The front end of the valve backer has the narrower width than the operating end of the reed valve and is superposed over the operating end of the reed valve. The configurations of the reed valve and the valve backer causes the reed valve to be moved as if the upper and lower edges of the letter "S" is obliquely extended and the head of the letter "S" is twisted. This spatially complicated movement of the reed valve produces stresses in the reed valve and the valve backer to accelerate the return of the reed valve to the closed position.

In order to achieve the objects, a third improvement is concerned in defining the configuration of the muffler of the discharge port unit, wherein the volumes of the resonance chambers are sequentially decreased as the positions of the resonance chambers depart from the discharge port of the valve assembly. In addition, the muffler comprises a passageway extending between the resonance chambers from a discharge port of the last one of the resonance chambers and flow resistances of the passageways of the muffler are sequentially increased as the positions of the passageways of the muffler depart from the discharge port of the valve assembly. In the configuration of the muffler, a counterpressure from valve assembly side components of the compressor to the discharge pressure of the working fluid is increased sequentially from the resonance chamber near the valve assembly to the last of the series of resonance chambers so that the working fluid discharged from the discharged port of the compressor unit has a moderate pressure gradient towards the discharge port unit. Thus the configuration of the muffler prevents a reduction in the compression efficiency and increase the effect of noise reduction.

Other objects, features and advantages of the present invention will be apparent from a consideration of the following description, taken in connection with the accompanying drawing.

BRIEF DESCRIPTION OF THE DRAWINGS

FIG. 18A is a front elevation of a second embodiment of the reed valve, showing a surface of the reed valve adjacent to the valve backer;

FIG. 18B is a front elevation of a third embodiment of the reed valve, showing a surface of the reed valve adjacent to the valve backer;

FIG. 18C is a front elevation of a second embodiment of the valve backer, showing a surface of the valve backer adjacent to the gasket;

FIG. 18D is a front elevation of a third embodiment of the valve backer, showing a surface of the valve backer adjacent to the gasket;

FIG. 18E is a side elevation of the valve backers of FIGS. 18C and 18D;

DETAILED DESCRIPTION OF THE PREFERRED EMBODIMENTS

Preferred embodiments of the present invention will be described with reference to the drawings hereinafter.

Figure 1:
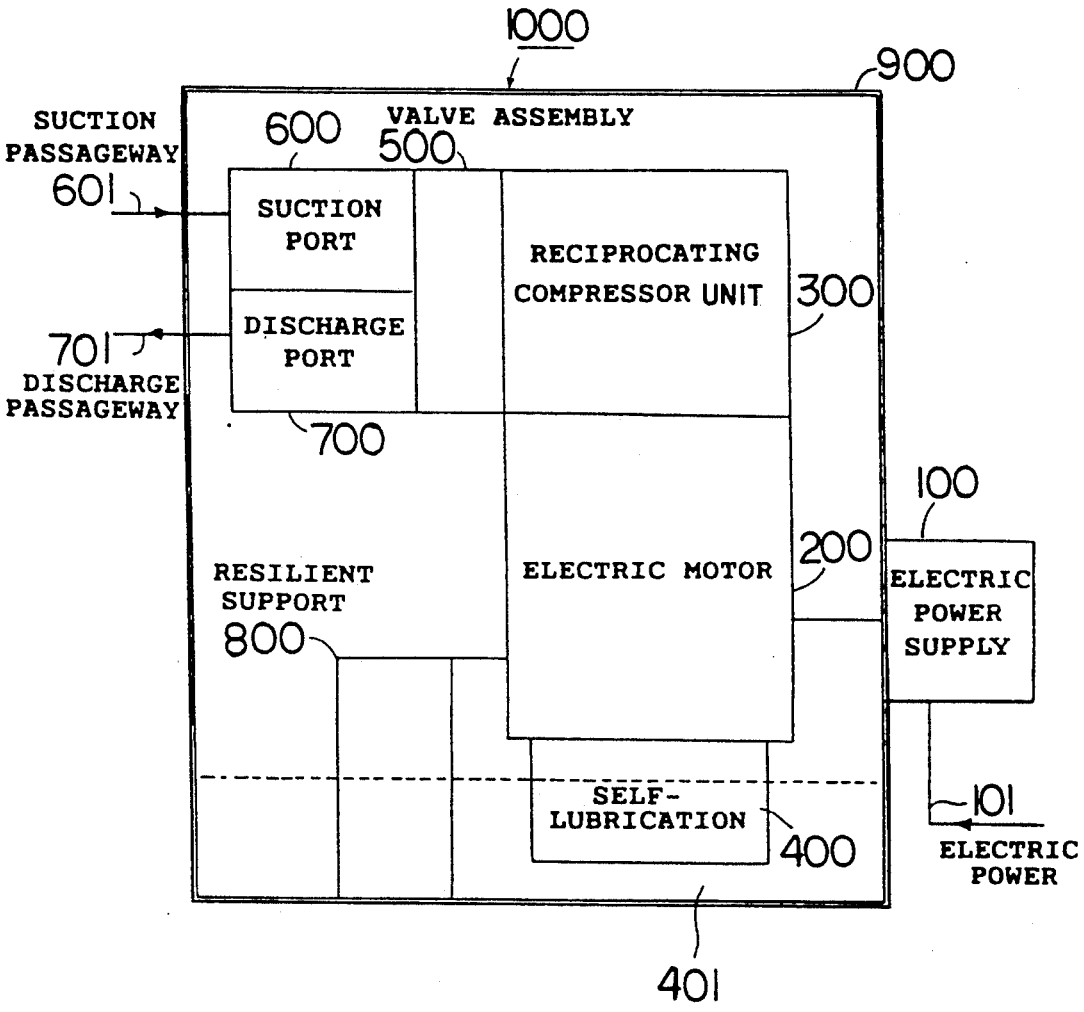
FIG. 1 is a block diagram illustrative of the arrangement of the components of a typical hermetically sealed electric motor compressor.
Figure 2:
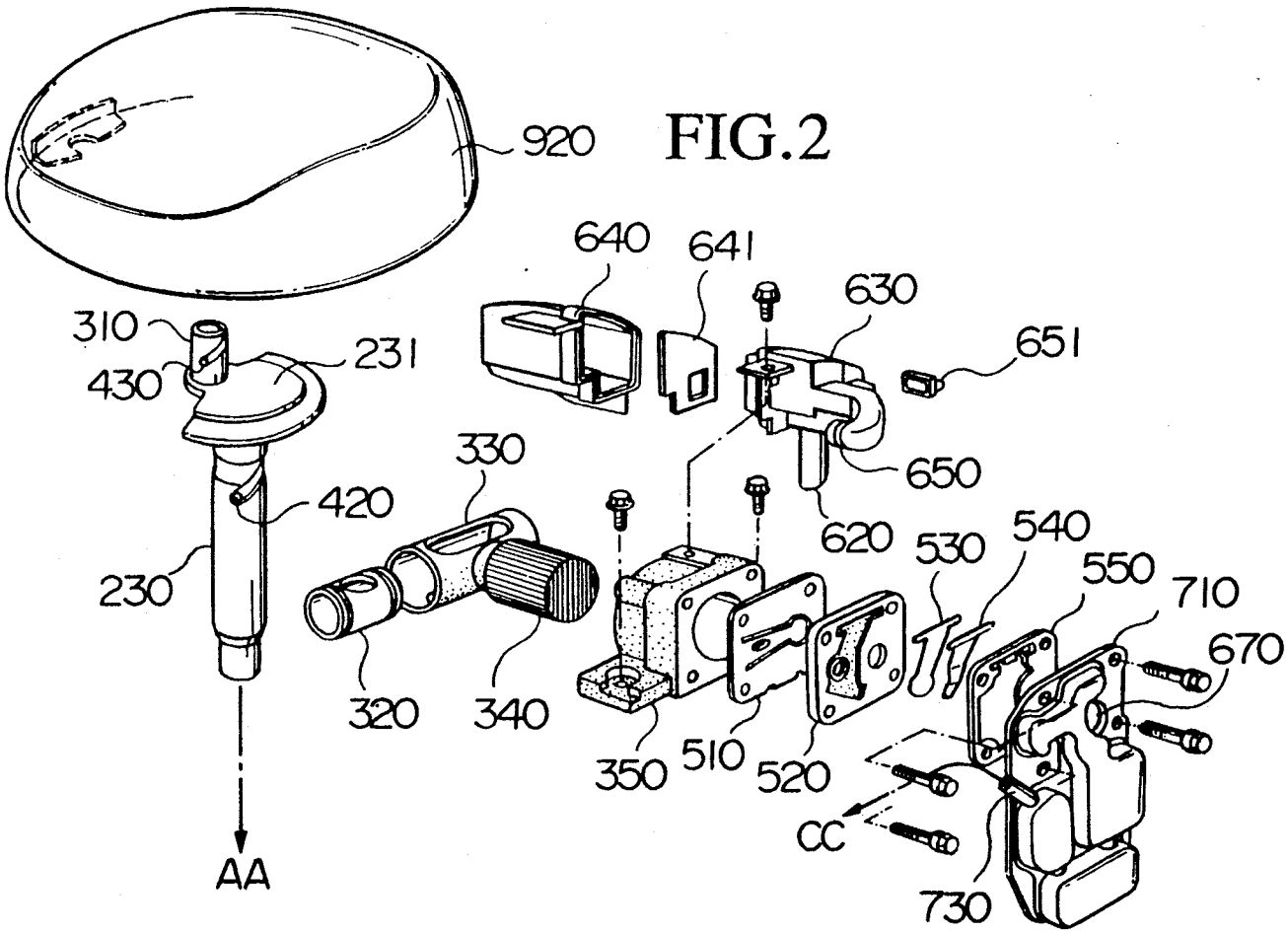
FIG. 2 is a first part of an exploded perspective view of a hermetically sealed electric motor compressor according to a first embodiment of the present invention.
Figure 3:
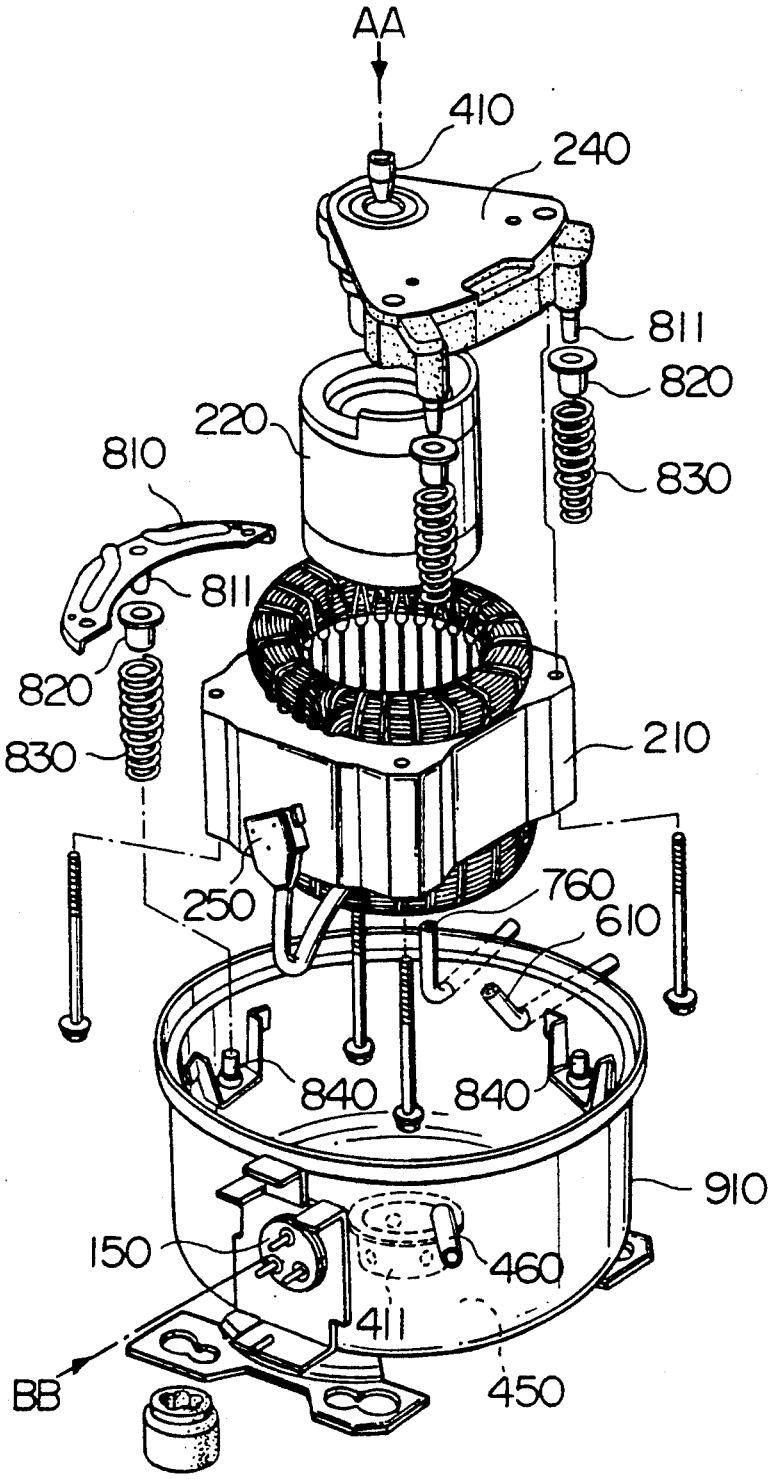
FIG. 3 is a second part of the exploded perspective view of the hermetically sealed electric motor compressor according to the first embodiment of the present invention.
Figure 4:
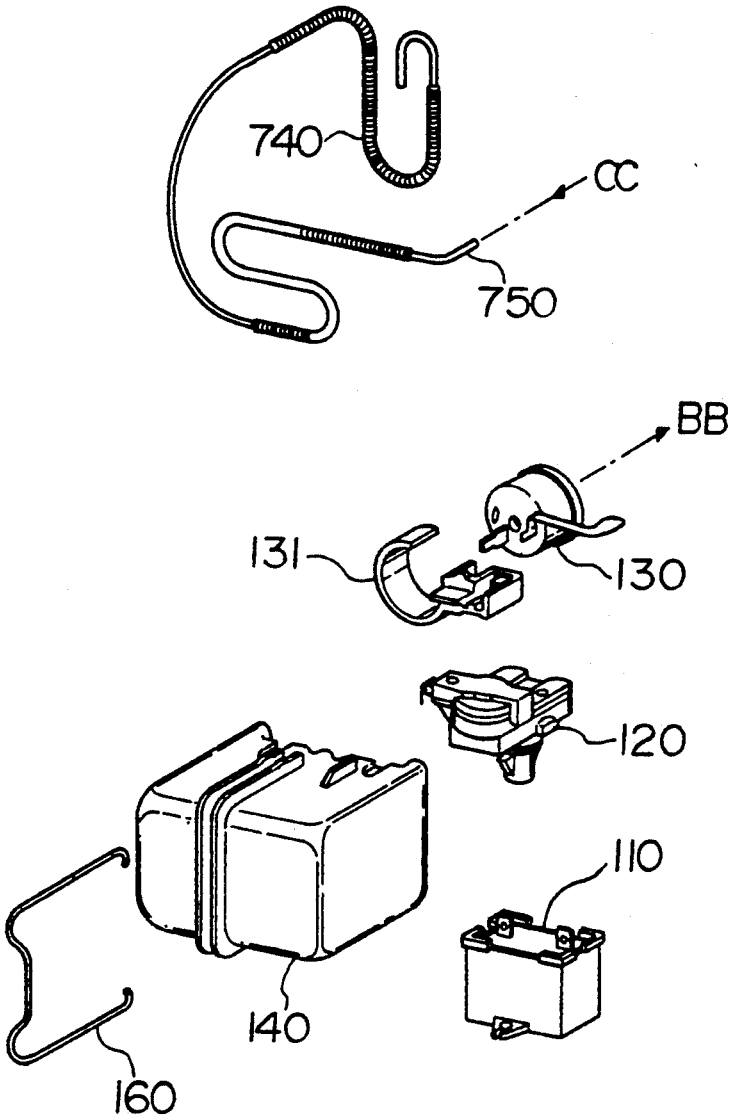
FIG. 4 is a third part of the exploded perspective view of the hermetically sealed electric motor compressor according to the first embodiment of the present invention.
Figure 5:
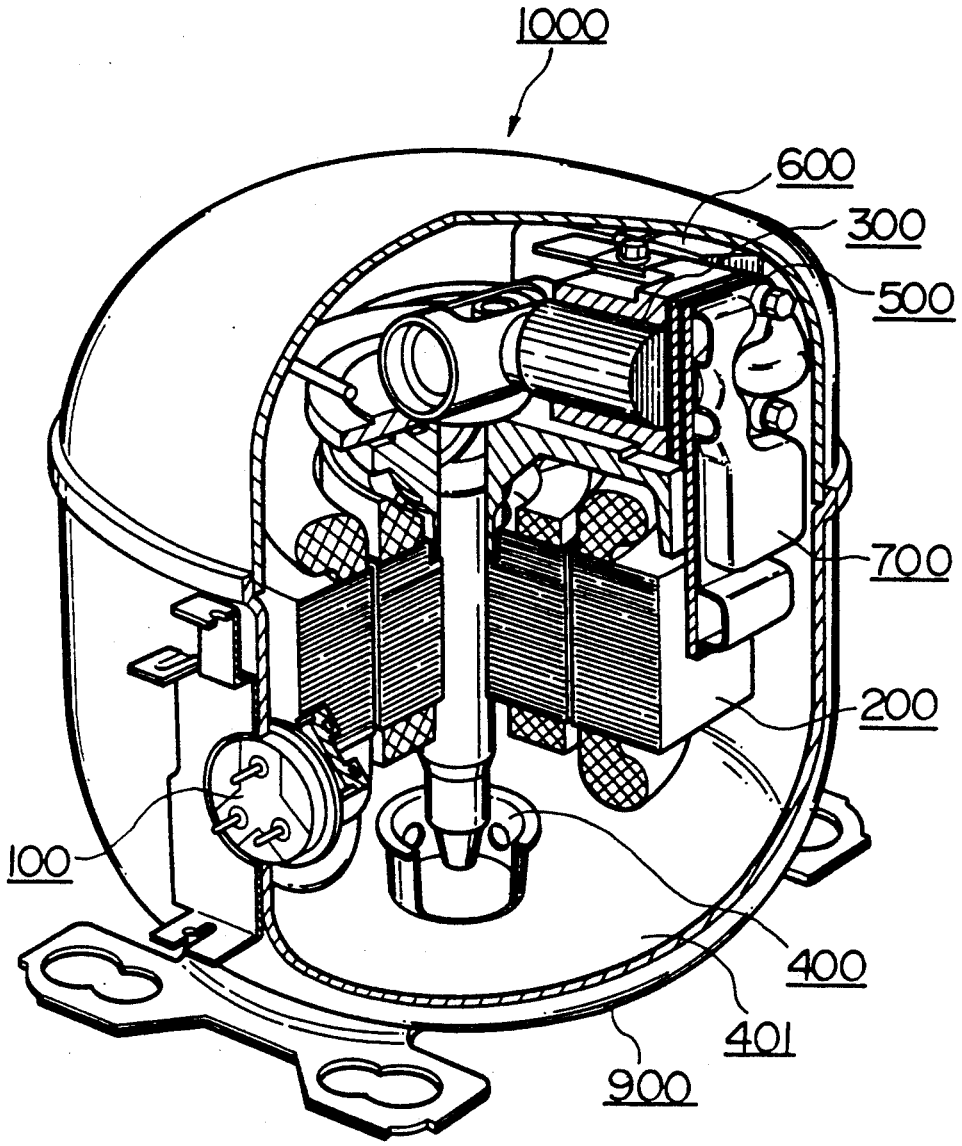
FIG. 5 is a cutaway perspective view of the interior of the hermetically sealed electric motor compressor according to the first embodiment of the present invention.

FIGS. 2-5 show the overall structure of a hermetically sealed electric motor compressor according to a first embodiment of the present invention and components of the compressor. FIGS. 2-4 are exploded perspective views of the compressor divided into three parts because of the sight size of the drawing. The parts of the compressor shown in FIGS. 2-4 continue one another so that the same assembly guide lines AA, BB and CC in chain lines are paired. Subassemblies having reference numerals are assembled in accordance with assembly guide lines in chain lines and locked with lock screws and retained with springs.

The electric power supply unit 100 comprises a phase-advancing capacitor 110, a current mode starter relay 120, an overload relay 130, a retainer for overload relay 131. A coupling of the electric power supply unit 100 is coupled with a terminal 150. A terminal cover 140 is then mounted on the coupling of the electric power supply unit 100. A retaining spring 160 is fitted on the terminal cover 140 to retain the coupling of the electric power supply unit 100 attached to a lower casing 910 of the hermetically sealed casing 900.

The electric motor 200 comprises a stator 210, a rotor 220, a rotor shaft 230 and a bearing-contained framework 240. The electric motor 200 is connected to the electric power supply unit 100 via an electric connector 250.

The resilient support 800 comprises an auxiliary framework 810 fastened to the flat top surface of the stator 210 and helical springs 830. The upper ends of the helical springs 830 are fitted via spring-retaining collars 820 around locating pins 811 fastened to the bearing-contained framework 240 and to the auxiliary framework 810. The lower ends of the helical springs 830 are fitted around locating pins 840 mounted on the bottom surface of the lower casing 910.

The upper end of the rotor shaft 230 has a semicircular or half-moon shaped balancing plate 231 integrated thereto. The upper end of the rotor shaft 230 has an eccentric pin 310 opposite to the convex edge of the balancing plate 231 so that the eccentric pin 310 smoothly rotates about the axis of the rotor shaft 230.

Figure 6:
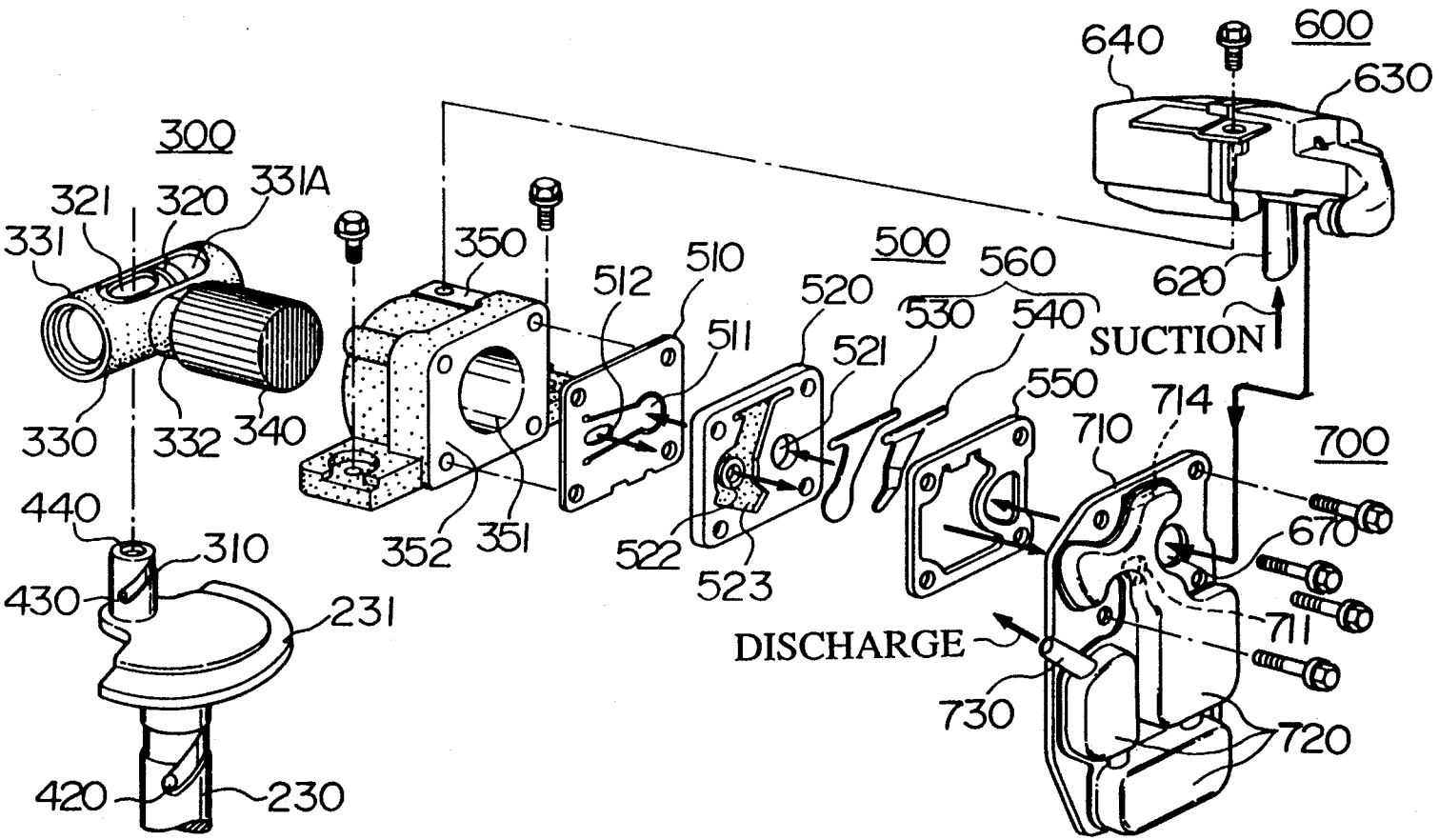
FIG. 6 shows a detailed enlarged view of main part of FIG. 2.

As best shown in FIG. 6, the eccentric pin 310 is fitted into a T-shaped crank assembly 330. The T-shaped crank assembly 330 comprises an axial tube 332, an outer transverse tube 331 and a sliding inner transverse tube 320 slidably mounted within the outer transverse tube 331. Upper and lower parts of the outer transverse tube 331 have slots 331A opposite each other. Upper and lower parts of the inner transverse tube 320 have bearing holes 321 opposite each other. The eccentric pin 310 is fitted into the bearing holes 321 in the inner transverse tube 320 through the slots 331A in the outer transverse tubule 331. Thus the eccentric pin 310 linearly reciprocates the axial tube 332. The axial tube 332 has a piston 340 in the form of bottomed hollow cylinder capped thereon. The piston 340 reciprocates within a cylinder bore 351 of a compressor cylinder block 350 to carry out compressing working. Thus the reciprocating compressor unit 300 comprises the eccentric pin 310, the T-shaped crank assembly 330, the piston 340 and the cylinder block 350.

The valve assembly 500 is sandwiched between the front surface 352 of the compressor cylinder block 350 and the base plate 710 of the discharge port unit 700. A detailed description of the valve assembly 500 mounted on the compressor cylinder block 350 will be later made with reference to FIG. 6.

As best shown in FIG. 6, the discharge port unit 700 comprises the base plate 710 and a discharge tube 730. The base plate 710 comprises a muffler assembly 720 defining a plurality of resonance chambers resonating with fluid vibrations of different frequencies to deaden noise. Working fluid discharged from a discharge hole 711 defined in the base plate 710 is discharged from the discharge tube 730 through the muffler assembly 720.

The discharge passageway 701 comprises the discharge tube 730, and an intermediate connecting tube 750 containing ribs 740 for moderating a pressure fluctuation and being connected to a discharge pipe 750 fitted into the lower casing 910.

The suction passageway 601 comprises a suction pipe 610 fitted into the lower casing 910 and connected to a suction port tube 620. As shown in FIG. 2, the suction port unit 600 comprises a muffler 630 containing a filter filtering foreign matters out of working fluid, a resonance chamber defining block 640 having a windowed partition 641 adjacent to the muffler 630, a connecting tube 650 having an inspection lid 651, and a connecting aperture 670 defined in the base plate 710 of the discharge port unit 700. Working fluid passes through the connecting suction tube 620, the muffler 630, the windowed partition 641, the resonance chamber defining block 640, the connecting tube 650 and the connecting aperture 670.

In assembly, an upper casing 920 of the hermetically sealed casing 900 is fitted into the lower casing 910 and hermetically sealed to the hermetically sealed electric motor compressor 1000 after the above-described subassemblies 1000, 200, 800, 330, 300, 500, 700 and 600 are built up in the lower casing 910. In this state of the compressor 1000, lubricating oil 401 is introduced into the lower casing 910 via an oil plug 460 attached to the sidewall of the lower casing 910 so that a cup-shaped splash guard 411 fastened to the bottom 450 of the lower casing 910 at the center thereof is fully immersed in the lubricating oil 401 in the lower casing 910.

The self-lubricating system 400 comprises a mouthpiece 410 in the form of hollow cylinder having a tapered axial hole and fitted on the bottomed end of the rotor shaft 230. The mouthpiece 410 is positioned at the center of the interior of the splash guard 411. The self-lubricating system 400 further comprises the rotor shaft 230 defining an axial bore, the eccentric pin 310 defining an axial bore 440. The axial bores in the rotor shaft 230 and in the eccentric pin 310 connect a lubricating hole 420 defined in the cylindrical wall of the rotor shaft 230 to a lubricating hole 430 defined in the cylindrical wall of the eccentric pin 310. A high-speed revolution of the rotor shaft 230 swirls air and lubricating oil 401 in the axial bore 440 in the eccentric pin 310 to cause a vacuum at the top open edge of the axial bore 440 to suck up lubricating oil 401 through the mouthpiece 410. The rotation of the electric motor 200 causes lubricating oil 401 splashing from the lubricating holes 420 and 430 and the axial bore 440 to lubricate them.

FIGS. 6–15 show the structure of the valve assembly 500 in detail.

As shown in FIG. 6, the valve assembly 500 comprises a suction valve plate 510, a valve seat 520, a reed valve 530, a restraining plate (herein after called as valve backer) 540 for the reed valve 530, and a gasket 550. In assembly, these components of the valve assembly 500 are sandwiched between the front surface 352 of the compressor cylinder block 350 and the rear surface 713 of the base plate 710 of the discharge port unit 700. The components of the valve assembly 500 are then bolted together with the compressor cylinder block 350 and the base plate 710 so that a suction passageway indicated by arrows directed to the left in FIG. 6 and a discharge passageway indicated by arrows directed to the right in FIG. 6 are provided in the valve assembly 500.

In detail, a reed valve assembly 560 comprises the reed valve 530 and the valve backer 540. The reed valve 530 is mounted on the valve seat 520 so as to open and close a discharge hole 522 defined in the valve seat 520 for discharging working fluid having a discharge pressure and a counterpressure alternating at a high speed. The valve backer 540 is positioned in front of the reed valve 530 so as to limit the opening of the reed valve 530 and resiliently back the reed valve 530 to restore the closed position.

After the reed valve assembly 560 is placed in a recess 523 defined in the valve seat 520, a projection 714 on the rear surface 713 of the base plate 710 pushes an end of the reed valve assembly 560 against the bottom of the recess 523.

The suction valve plate 510 is made of a flat metal (e.g. stainless steel) leaf spring with a thickness $t_1$ both surfaces of which are finished by polishing. The suction valve plate 510 comprises a reed valve 511 cut in a central part thereof so that the base end of the reed valve 511 is continuous with the other part of the suction valve plate 510. The base end of the reed valve 511 has a discharging aperture 512 larger than the discharge hole 522 in the valve seat 520 later described in detail.

Figure 7:
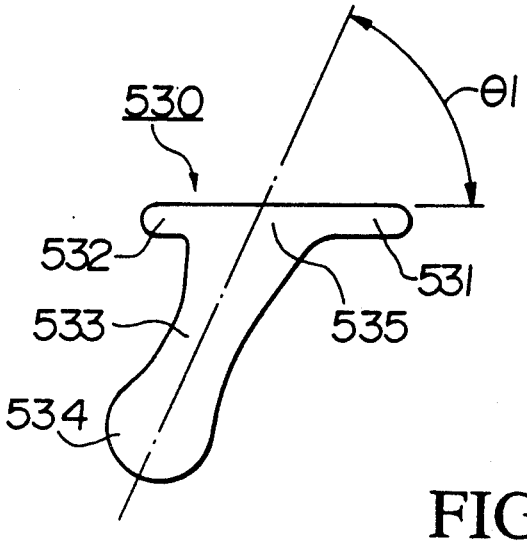
FIG. 7 is a front elevation of a first embodiment of a read valve, showing a surface of the reed valve adjacent to a valve backer.

The reed valve 530 is made of a flat thin leaf spring, e.g., a thin stainless steel leaf spring both surfaces of which are finished by polishing. As shown in FIG. 7, the reed valve 530 has a fixed end 535, an intermediate portion 533 and a round operating end 534 opposite the fixed end 535. The fixed end 535 extends laterally of the intermediate portion 533 and terminates in fulcrums 531 and 532. The axis of the reed valve 530 and therefore the axis of the intermediate portion 533 have an acute angle $\theta_1$ from a straight line joining the fulcrums 531 and 532. The operating end 534 opens and closes the discharging hole 522. The base end of the intermediate portion 533 adjoining the fixed end 535 of the reed valve 530 is tapered towards the operating end 534.

Since the intermediate portion 533 of the reed valve 530 extends obliquely at the angle $\theta_1$ to the axis of the fixed end 535, the length of the right-hand half of the intermediate portion 533 plus the operating end 534 is longer than the length of the left-hand half of the intermediate portion 533 plus the operating end 534. Thus the right-hand half thereof has a leverage larger than the left-hand half thereof so that the right-hand half of the operating end 534 is lifted up along the normal line to the sight of FIG. 7 more easily and higher than the left-hand half thereof when the operating end 534 receives the discharge pressure of working fluid discharged from the discharging hole 522. This causes the operating end 534 and the intermediate portion 533 to be twisted about the axis of the reed valve 530. In addition, the tapering shape of the base end of the intermediate portion 533 facilitates the twisting of the intermediate portion 533.

Figure 8B:
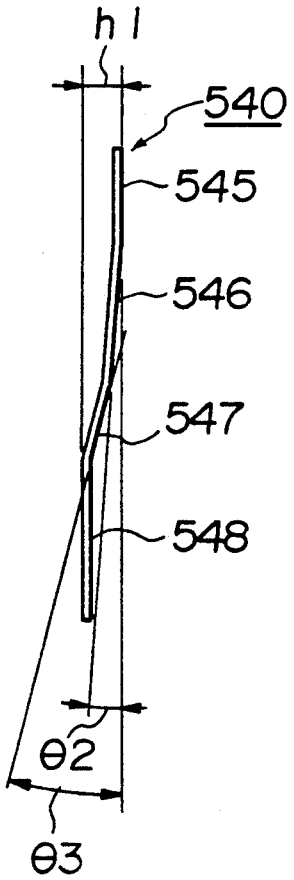
FIG. 8B is a side elevation of the valve backer of FIG. 8A.
Figure 8A:
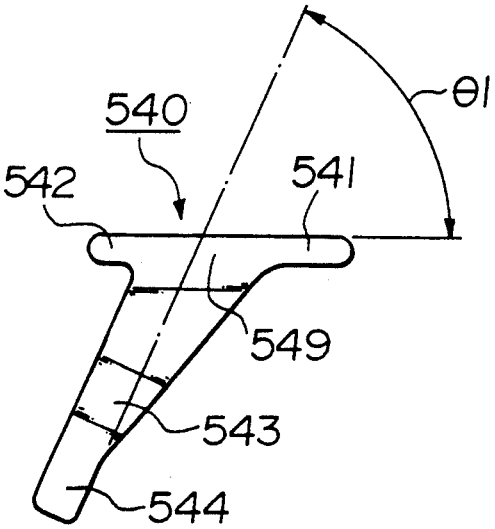
FIG. 8A is a front elevation of a first embodiment of the valve backer, showing a surface of the valve backer adjacent to a gasket.

The valve backer 540 is made of a thin leaf spring, e.g., a thin stainless steel leaf spring both surfaces of which are finished by polishing and shaped as shown in FIGS. 8A and 8B. Like the reed valve 530, the valve backer 540 comprises a fixed end 549, an intermediate portion 543 and a front end 544. The fixed end 549 extends laterally of the intermediate portion 543 and has fulcrums 541 and 542 at the opposite ends thereof. The intermediate portion 543 extends from the fixed end 549 at the acute angle $\theta_1$ (i.e. obliquely) to a straight line joining the fulcrums 541 and 542. The intermediate portion 543 is tapered from the fixed end 549 to the front end 544. The front end 544 has a width equal to approximately ½ of the width of the operating end 534 of the reed valve 530. As shown in FIG. 8A, the front end 544 is positioned on only the left side of the axis of the valve backer 540.

As shown in FIGS. 8A and 8B, the fixed end 549 and the front end 544 have parallel positions 545 and 548. The valve backer 540 has such profile that the valve backer 540 comprises the flat base portion 545 including the base end 549, a first oblique portion 546 extending from the flat base portion 545 at a smaller angle $\theta_2$, a second oblique portion 547 extending from the first oblique portion 546 at a larger angle $\theta_3$ to the flat base portion 545, and the flat front portion 548.

Figure 9A:
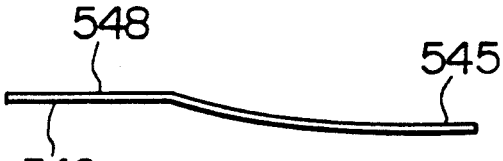
FIG. 9A is a side elevation of a second embodiment of the valve backer.
Figure 9B:
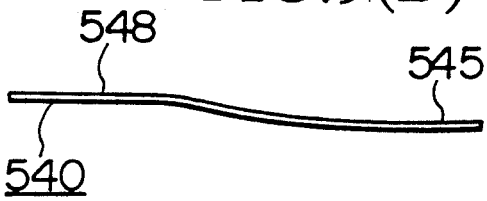
FIG. 9B is a side elevation of a third embodiment of the valve backer.

The intermediate portion 543 alternatively has the profile of a quadratic curve shown in FIG. 9A or FIG. 9B so that a part of the intermediate portion 543 near the fixed end 549 has a smaller curvature and a part of the intermediate portion 543 near the front end 544 has a larger curvature. In the second embodiment of the valve backer 540 shown in FIG. 9A, a joint of the flat portion 548 and the intermediate portion 543 has an angle. In the third embodiment of the valve backer 540 shown in FIG. 9B, a joint of the flat portion 548 and the intermediate portion 543 is curved.

The reed valve 530 and the valve backer 540 are positioned so that the axes of them are superposed. Since the shape of the valve backer 540 is similar to that of the reed valve 530 and the valve backer 540 is superposed over the reed valve 530, the reed valve 530 is resiliently deformed to follow the normal form and the resilient deformation of the valve backer 540 when the reed valve 530 is lifted up along the normal line to the sight of FIG. 7 by the discharge pressure of working fluid discharged from the discharging hole 522. The position and the shape of the front end 544 of the valve backer 540 facilitate the twisting of the reed valve 530.

As shown in FIG. 8B, the valve backer 540 has the height $h_1$. Since a reference line of inclination of the first oblique portion 546 is parallel to the straight line joining the fulcrums 541 and 542, the base-side reference line of inclination and the front-side reference line of inclination of the second oblique portion 547 are parallel to each other and have right angle to the axis of the valve backer 540, the shape of the valve backer 540 facilitates the reed valve 530 to have different deformations on the right and left sides of the axis of the reed valve 530.

Figure 10A:
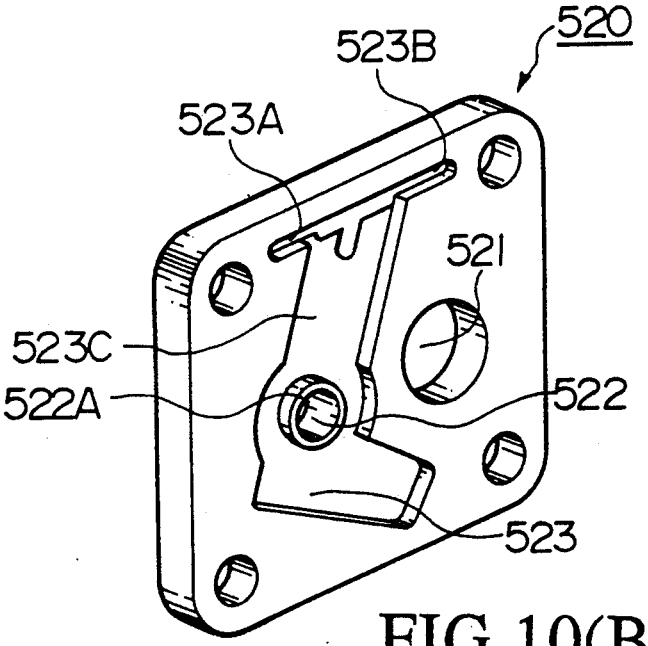
FIG. 10A is a perspective view of a first embodiment of a valve seat, showing a surface of the valve seat adjacent to the gasket.
Figure 10B:
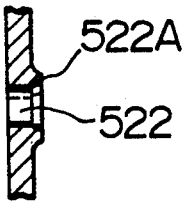
FIG. 10B is a sectional view of a discharge hole defining part of the valve seat of FIG. 10A.

The valve seat 520 is made of a thick metal (e.g. stainless steel) plate and has a shape shown in FIGS. 10A and 10B. The front surface of the valve seat 520 has a recess 523 having the contour similar to the contour of the reed valve 530. The recess 523 comprises first recesses 523A and 523B and a second recess 523C. The first recesses 523A and 523B have the same contour as the fixed end 535 of the reed valve 530 and receive the fulcrums 531 and 532 of the reed valve 530 and the fulcrums 541 and 542 of the valve backer 540 superposed thereon. The second recess 523C receives the intermediate portion 533 and the operating end 534 of the reed valve 530, and the intermediate portion 543 and the front end 544 of the valve backer 540. The second recess 523C has a discharging hole 522 at a place adjacent to the operating end 534 of the reed valve 530.

The valve seat 520 is shaped by forging and stamping to provide the recess 523 and a suction hole 521 and discharge hole 522 and four bolt passing holes in the corners of the valve seat 520. The front and rear surfaces of the valve seat 520 are finished by polishing. The discharge hole 522 has a cylindrical rim 522A projecting forwards. The front edge surface of the rim 522A is finished by polishing to provide a surface for seating the reed valve 530. As shown in FIG. 10A, the valve seat 520 has the suction hole 521 outside the recess 523 adjacent to the reed valve 511 of the suction valve plate 510.

Figure 11A:
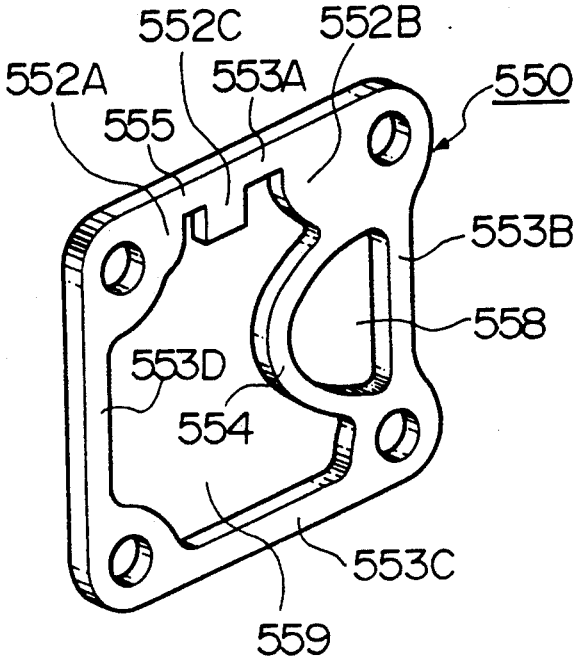
FIG. 11A is a perspective view of a first embodiment of the gasket, showing a surface of the gasket adjacent to a base plate of a discharge port unit.
Figure 11B:
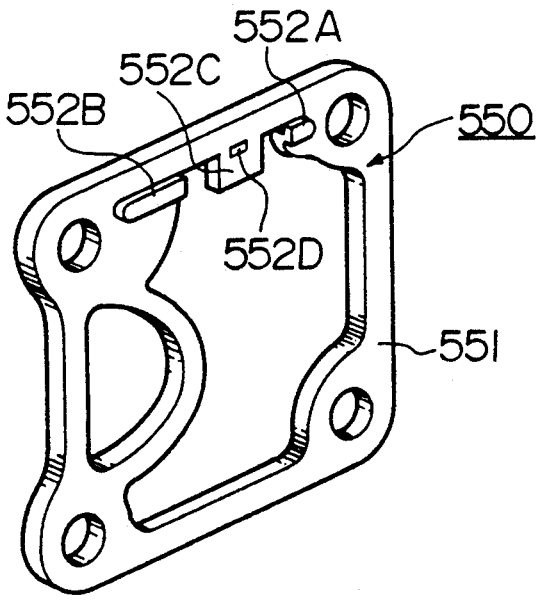
FIG. 11B is a perspective view of the second embodiment of the gasket, showing a surface of the gasket adjacent to the valve seat.

The gasket 550 is sandwiched between the valve seat 520 and the base plate 710 of the discharge port unit 700. The gasket 550 is made of a sheet of an elastic synthetic resin, e.g., a fibers-containing butyl rubber and molded as shown in FIGS. 11A or 11B. The gasket 550 comprises sides 553A, 553B, 553C and 553D hermetically sealing clearances between the peripheries of the valve seat 520 and the base plate 710. The gasket 550 further comprises a curved partition 554 separating a suction passage 558 from a discharge passage 559. The gasket 550 has tongue-shaped ribs 552A, 552B and 552C pushing the fixed end 535 of the reed valve 530 and the fixed end 549 of the valve backer 540. The tongue-shaped ribs 552A, 552B and/or 552C are pushed and deformed by a projection 714 of the base plate 710 from the front surface 555 of the gasket 550. This will be described later in detail. Further, when the valve assembly 500 is assembled during manufacturing, the reed valve 530 and the valve backer 540 are temporarily held within the recess 523 of the valve seat 520 by pushing the ribs 552A and 552B within the recesses 523A and 523B of the valve seat 520 with e.g. finger or jig.

Figure 12A:
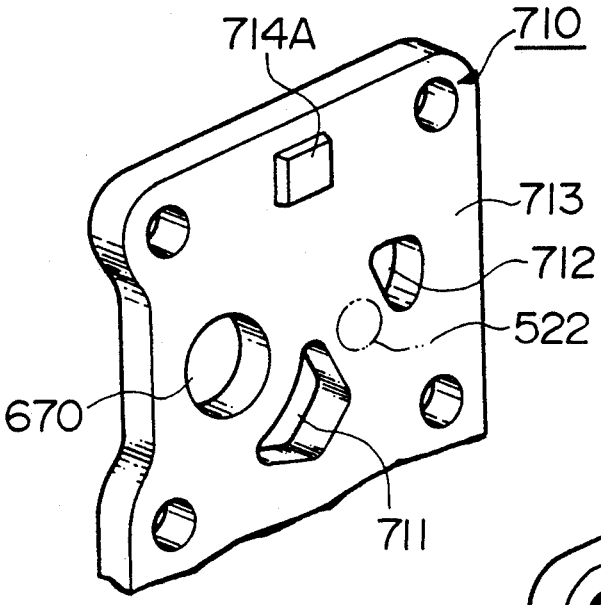
FIG. 12A is a perspective view of a first embodiment of the base plate of the discharge port unit, showing a surface of the base plate adjacent to the gasket.
Figure 12C:
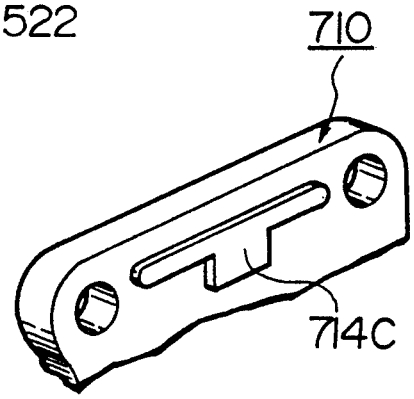
FIG. 12C is a perspective view of a third embodiment of the base plate of the discharge port unit, showing a surface of the base plate adjacent to the gasket.
Figure 12B:
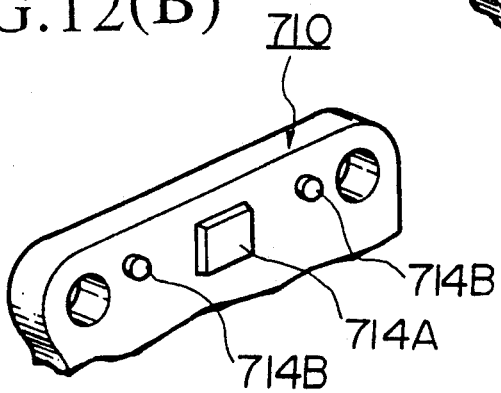
FIG. 12B is a perspective view of a second embodiment of the base plate of the discharge port unit, showing a surface of the base plate adjacent to the gasket.
Figure 13:
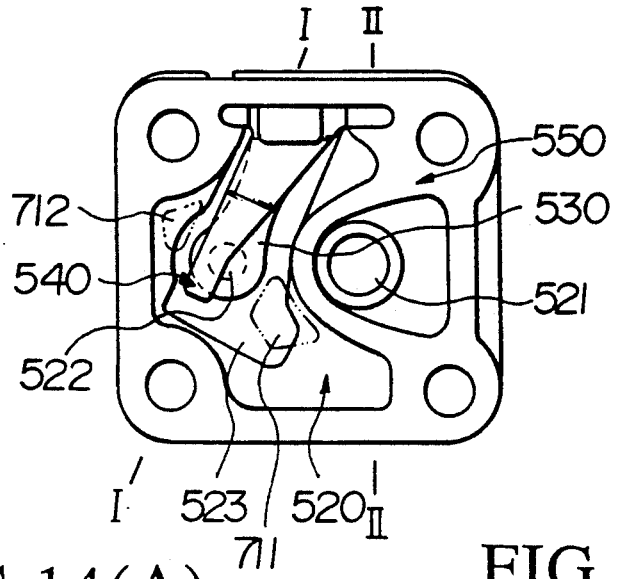
FIG. 13 is a front elevation of a subassembly of the first embodiment of the valve assembly, the first embodiment of the reed valve, the first embodiment of the valve backer, the first embodiment of the gasket and the first embodiment of the base plate.

The base plate 710 is made of a thickened metal (e.g. stainless steel) sheet and shaped as shown in FIGS. 12A, 12B or 12C. The rear surface of the base plate 710 adjoining the gasket 550 has the projection 714 pushing the gasket 550 to be deformed to retain the portions to be fixed, 531, 532, and 535 of the reed valve 530 and 541, 542 and 549 of the valve backer 540 within the first recesses 523A and 523B by the elasticity of the gasket 550. As shown in FIGS. 12A and 13, the base plate 710 has a discharge hole 711 at a position on a vertical line passing through the center of the base plate 710. That is, the position of the discharge hole 711 deviates from the axis of the reed valve 530 and the position of the discharge hole 522 to the right as shown in FIG. 13. The discharge hole 711 communicates with the discharge passageway 701.

The projection 714 may have different shapes by hardness of the material of the gasket 550. Where the hardness of the material of the gasket 550 is relatively high, the base plate 710, as shown in FIG. 12A, has a single rectangular projection 714A pushing the central rib 552C of the gasket 550 to retain the fixed end 535 of the reed valve 530 and the fixed end 549 of the valve backer 540. In this case, the rear surface of the gasket 550 may have been flatly molded and the peripheral flat ribs 552B and 552C on the both sides of the central rib 552C are functioned as temporarily secure means so as to securely retain the fulcrums 531 and 532 of the reed valve 530 and the fulcrums 541 and 542 of the valve backer 540 on the recess 523 of the valve seat 520 by pushing them by finger or jig when the valve assembly is subassembled. In another embodiment as shown in FIG. 11B, the rear surface of gasket 550 may have the ribs 522A and 522B as projecting ribs so as to more securely retain them on the recess 523 of the valve seat 520. On the other hand, where the hardness of the material of the gasket 550 is relatively intermediate or low, the base plate 710, as shown in FIG. 12B, may have small projections 714B to securely retain the fulcrums 531, 532, 541 and 542 of the reed valve 530 and the valve backer 540. In addition, the rear surface of the base plate 710 may have a projection 714C pressing the entire fixed end 549 of the valve backer 540 through the tongue-shaped ribs 552A, 552B and 552C as shown in FIG. 12C.

As shown in FIG. 12A, the base plate 710 may have a auxiliary discharge hole 712 opposite the discharge hole 711 through a position adjacent to the position of the discharge hole 522 in the valve seat 520. The discharge hole 711 provides a main passageway for working fluid immediately after working fluid is discharged from the discharge hole 522. The auxiliary discharge hole 712 provides an auxiliary passageway for precluding a counterflow of working fluid to the discharge hole 522 when the counterpiece applied to the front surface of the reed valve 530 excesses the discharge pressure of working fluid.

All of the suction valve plate 510, the valve seat 520, the reed valve 530, the valve backer 540, the gasket 550, and the base plate 710 and so on are demagnetized, so that they cannot stick on one another during operation of them.

FIG. 13 shows a front elevation of a subassembly of the valve seat 520, the reed valve 530, the valve backer 540, the gasket 550, and the base plate 710 for understanding the positional relationship of them. In FIG. 13, showings of elements of the base plate 710 other than the discharge holes 711 and 712 are eliminated.

Figure 14A:
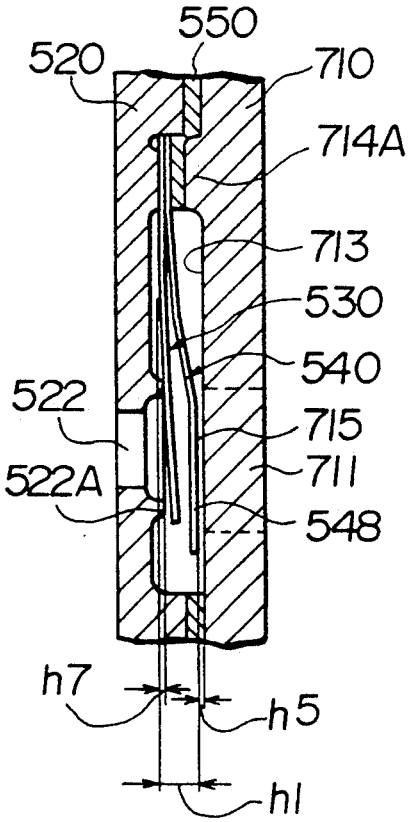
FIG. 14A is a section of the subassembly of FIG. 13 taken along the line I—I in FIG. 13.
Figure 14B:
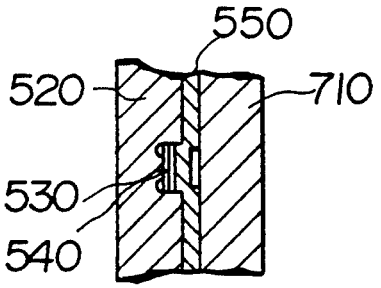
FIG. 14B is a section of the subassembly of FIG. 13 taken along the line II—II in FIG. 13, showing a section of the first embodiment of the base plate.
Figure 14C:
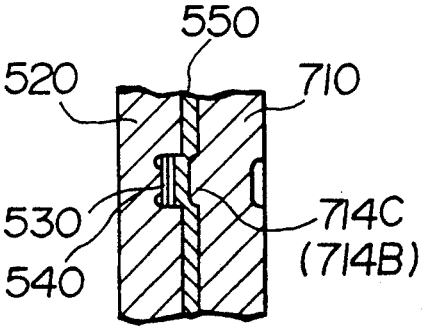
FIG. 14C is a section of the subsassembly of FIG. 13 taken along the line II—II in FIG. 13, showing a section of a second or a third embodiment of the base plate.

FIG. 14A is a section taken along the line I—I in FIG. 13 coinciding with the axis of the reed valve 530. FIGS. 14B and 14C are sections taken along the line II—II in FIG. 13 passing through the fulcrum 531 of the reed valve 530. As shown in FIG. 14A, the second flat portion 548 of the valve backer 540 and the rear surface 713 of the base plate 710 define a clearance 715 having a height $h_5$ therebetween. The provision of the clearance 715 prevents the valve backer 540 from sticking on the rear surface 713 of the base plate 710 and enables the valve backer 540 to retain the flatness of the second flat portion 548 when the reed valve 530 is in the closed position.

The height of the rim 522A of the discharge hole 522 excesses the height of the mount for the reed valve 530 by a height $h_7$ so that the operating end 534 of the reed valve 530 cannot stick on the front edge surface of the rim 522A of the discharge hole 522.

FIG. 14A shows a state that the reed valve 540 receives no discharge pressure of working fluid. The ribs 552A, 552B and 552C of the gasket 550 push the fixed ends 535 and 549 of the reed valve 530 and the valve backer 540. In particular, the ribs 552A and 552B of the gasket 550 push the fulcrums 521, 532, 541 and 542 yielding large moments.

Figure 15:
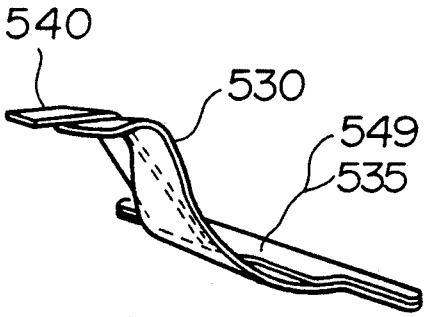
FIG. 15 is a perspective view of a reed valve assembly of the first embodiments of the reed valve and the valve backer during working (opening the discharge port)

Therefore the reed valve 530 receives the pressure of working fluid discharged from the discharge hole 522 and spatially complicatedly is bent. FIG. 15 illustrates such configurations of the reed valve 530 and the valve backer 540 spatially complicatedly bent as if a cobra raises and twists its head, i.e., such configuration that the upper and lower edges of the letter "S" is obliquely extended and the upper portion of the letter "S" is twisted. The spatially complicated bending causes stresses in the reed valve 530 and the valve backer 540.

Once a counterpressure excesses the discharge pressure of working fluid in the hole 559 between the valve seat 520 and the base plate 710, the stresses in the reed valve 530 and the valve backer 540 caused by the spatially complicated bending of the reed valve 530 and valve backer 540 appear as a large resilient force of the reed valve 530 to close the discharge hole 522. Since the resilient force of the reed valve 530 straightens the S-shaped configuration thereof, the operating end 534 of the reed valve 530 strikes the front edge surface of the rim 552A of the discharge hole 552 so that the reed valve 530 closes the discharge hole 552 before a counterflow of discharged working fluid passes into the discharge hole 552. Thus the reed valve 530 as much reduces the volume of working fluid returning to the discharge hole 552 as possible.

The hermetically sealed electric motor compressor 1000 with the valve assembly 500 described above increases the compression efficiency, so that a refrigerator with the hermetically sealed electric motor compressor 1000 increases the coefficient of performance.

For example, dimensions of the reed valve 530 and the valve backer 540 are as follows: The thicknesses of the materials of the reed valve 530 and the valve backer 540 are 0.2 mm each. The thickness of the material of the gasket 550 is 1 mm. The thickness of the material of the valve seat 520 is 3.3 mm. The valve of $h_1$ is 1.5 mm. The valve of $h_5$ is 0.3 mm. The valve of $h_7$ is 0.05 mm. The diameter of the discharge hole 552 is 4.5 mm. The angle $\theta_1$ is 65°. The angle $\theta_2$ is 2.5°. The angle $\theta_3$ is 3.5°.

Figure 16:
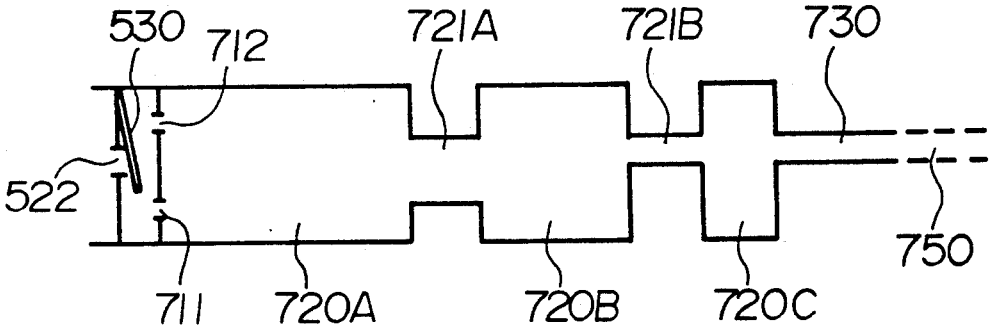
FIG. 16 is a schematic diagram illustrative of the arrangement of the first embodiment of the valve seat, the first embodiment of the reed valve assembly, and the discharge port unit including the muffler and a discharge passageway extending from the discharge port.
Figure 17A:
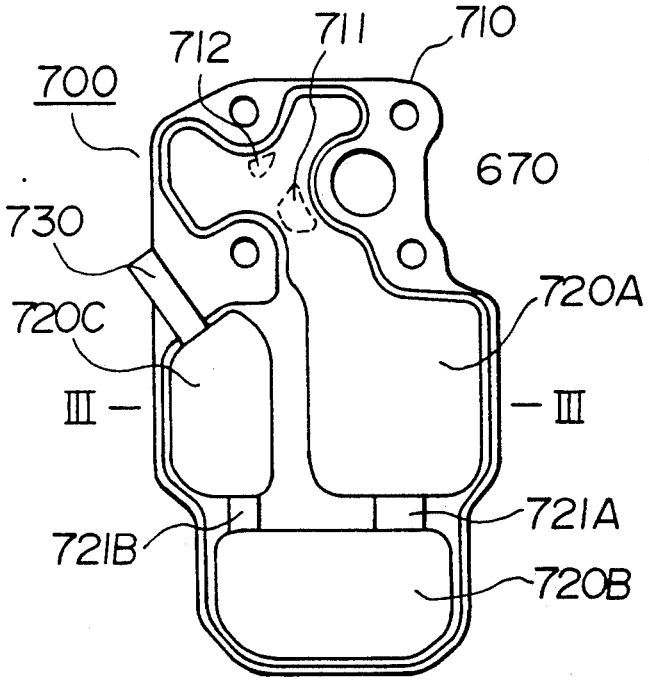
FIG. 17A is a front elevation of the discharge port unit.
Figure 17B:
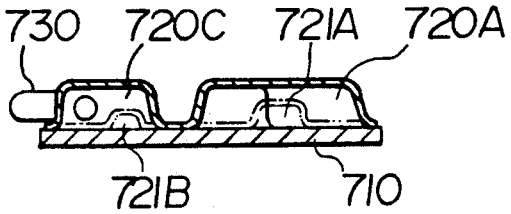
FIG. 17B is a section of the discharge port unit taken along the line III—III in FIG. 17A.

FIG. 16 is a schematic diagram of the muffler assembly 720. FIG. 17A shows the arrangement of the muffler assembly 720. FIG. 17B is a section of the base plate 710 taken along the line III—III in FIG. 17A.

As shown in FIG. 16, working fluid from the discharge hole 522 in the valve assembly 500 sequentially passes through the discharge hole 559 in the gasket 550, the discharge holes 711, 712, a first resonance chamber 720A, a connecting passageway 721A, a second resonance chamber 720B, a connecting passageway 721B and a third resonance chamber 720C and is discharged from the discharge tube 730.

The volume of the resonance chambers 720A, 720B and 720C are sequentially decreased as the positions of them depart from the discharge hole 522. The flow resistances of the connecting passageways 721A, 721B and 730 are sequentially increased as the positions of them depart from the discharge hole 522.

As shown in FIG. 17B, the muffler assembly 720 is made of a thin stainless steel and drawn in the form of dishes by a press. The open edges of the muffler assembly 720 are joined, e.g., by soldering to the front surface of the base point 710 of the discharge port unit 700 to define the resonance chambers 720A, 720B and 720C and the passageways 721A and 721B together with the base plate 710.

The performance of the resonance chambers 720A, 720B and 720C are increased when the volumes of them are related with unit discharge Q of the reciprocating compressor unit 300 (i.e. the volume of working fluid displaced by the piston 340 in the compressor cylinder bore 351 in a single stroke). For example, the volume of the first resonance chamber 720A is approximately 2.5 Q, the volume of the second resonance chamber 720B is approximately 1.5 Q and the volume of the third resonance chamber 720C is approximately 0.75 Q.

The configuration of the muffler assembly 720 provides a moderate or relatively low pressure gradient to working fluid discharged from the discharge hole 522 to prevent the compression efficiency from degrading and increase the noise reduction effect.

Modified embodiments of the valve assembly 500 will be described hereinafter. In a second embodiment of the valve assembly 500, a fixed end of a second embodiment of the reed valve 530, as shown in FIG. 18A, has no extended fulcrums. A second embodiment of the valve backer 540, as shown in FIG. 18C, has no extended fulcrum. The axes of the reed valve 530 and the valve backer 540 have the acute angle $\theta_1$ from the edge surfaces of the fixed ends of the reed valve 530 and the valve backer 540.

Figure 19A:
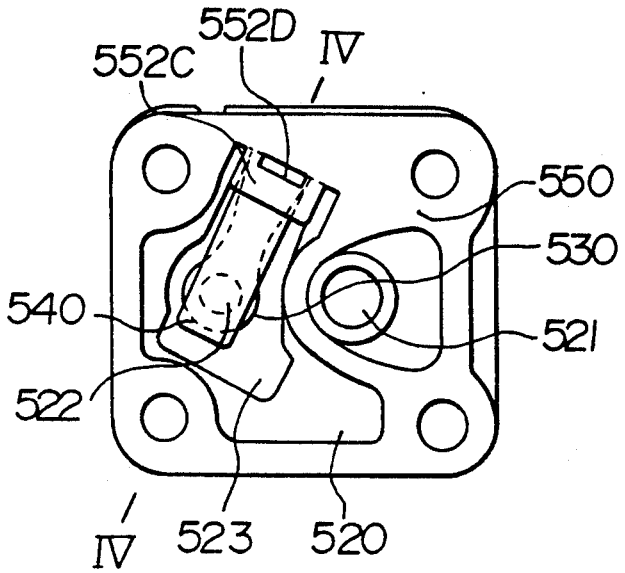
FIG. 19A is a front elevation of a subassembly of a second embodiment of the valve assembly, the reed valve of FIG. 18B, the valve backer of FIG. 18D, a second embodiment of the gasket and a second embodiment of the base plate.

In a third embodiment of the valve assembly 500, the fixed end of a third embodiment of the reed valve 530 and the fixed end of a third embodiment of valve backer 540, as shown in FIGS. 18B and 18D, have no extended fulcrums. The axes of the reed valve 530 and the valve backer 540 have right angle from the edge surfaces of the fixed ends of the reed valve 530 and the valve backer 540. The valve backer 540 has a single reference line of inclination so that an intermediate portion 543 and the front end 544 of the valve backer 540 is oblique to the flat fixed end 549 of the valve backer 540. The reed valve 530 and the valve backer 540 are symmetrical of the axes thereof. The intermediate portion 543 and the front end 544 of the valve backers 540 of FIGS. 18C and 18D have an angle $\theta_4$ (e.g. 5°) from the flat fixed ends 549 thereof. The reed valves 530 and the valve backers 540 of FIGS. 18A to 18D require modified valve seat 520 and gasket 550 shown in FIGS. 19A and 19B. The root of a central rib or retainer 552C of the gasket 550 has a rectangular through-hole 552D making the central rib 552C more flexible. The through-hole 552D facilitates the projection 714A of the base plate 710 to push the central rib 552C of the gasket 550 on the fixed end 549 of the valve backer 540, so that the projection 714A securely retains the fixed ends 535 and 549 of the reed valve 530 and the valve backer 540.

Figure 19B:
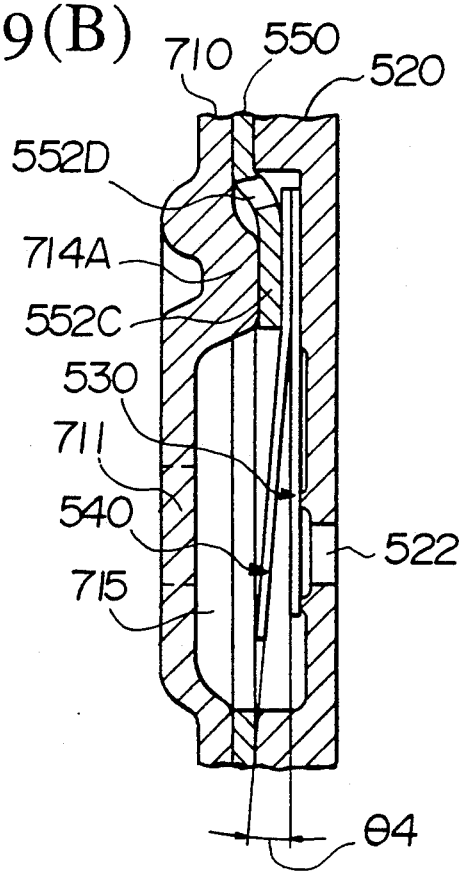
FIG. 19B is a section of the subassembly of FIG. 19A taken along the line IV—IV in FIG. 19A.

In a fourth embodiment of the valve assembly 500, the rear surface 713 of a second embodiment of the base plate 710, as shown in FIG. 19B, has a recess 715 defined in front of the valve backer 540 since the reed valve 530 is not twisted by the discharge pressure of working fluid from the discharge hole 522 to deviate from the position of the discharge hole 522.

Figure 20:
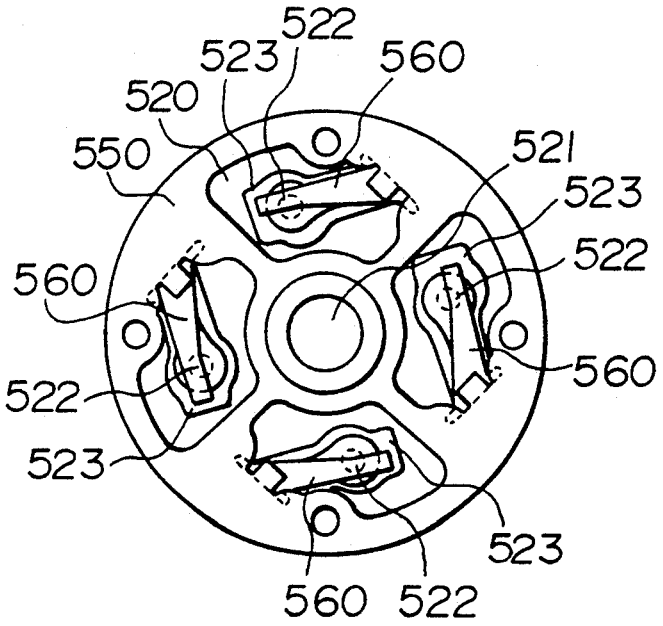
FIG. 20 is a front elevation of a subassembly of a third embodiment of the valve assembly, the reed valve of FIG. 7, the valve backer of FIG. 8A, a third embodiment of the gasket and a third embodiment of the base plate.

In a fifth embodiment of the valve assembly 500 which is employed in a compressor with the reciprocating compressor unit 300 having a large discharge, a third embodiment of the valve seat 520, as shown in FIG. 20, has a suction hole 521 at the center thereof and a plurality (e.g. four) of discharge holes 522 surrounding the suction hole 521. Each of the discharge holes 522 has a reed valve assembly 560. A third embodiment of the gasket 550 shown in FIG. 20 and a third embodiment of the base plate 710 not shown in FIG. 20 are required.

In a sixth embodiment of the valve assembly 500, the rear surface 551 of the gasket 550 has an adhesive applied thereto. The valve seat 520, the reed valve 530, the valve backer 540 and the gasket 550 constitute a one-piece subassembly of the valve assembly 500. Thus the reed valve 530 and the valve backer 540 cannot spring out of the valve assembly 500 during assembly process of the valve assembly 500. For a repair of the valve assembly 500, a new one-piece subassembly easily replaces an old one-piece subasssembly.

The rear surface of the gasket 550 of this one-piece subassembly has an adhesive layer applied thereto and a protective paper covering the adhesive layer before the assembly process of the valve assembly 500. The gasket 550 is die cut. During assembly process of the valve assembly 500, the protective paper is removed and the valve seat 520, the reed valve 530, the valve backer 540 and the gasket 550 then are assembled into the one-piece subassembly, and an upper die having projections corresponding to the projections 714 shown in FIG. 12 presses on the gasket 550 together with the valve seat 520 as a lower die to facilitate the assembly process of the valve assembly 500.

The sizes of the components of the valve assembly 500 and the angles may be changed without hindrances in the operations of the components. The thicknesses of the materials of the reed valve 530 and the valve backer 540 may alternatively be different. The materials of the reed valve 530 and the valve backer 540 may alternatively have different Young's moduli. The valve backer 540 may alternatively have four or more reference lines of inclination to approximate the oblique portions of the valve backer 540 to a quadratic surface. The base plate 710 of the discharge port unit 700 may alternatively lack the auxiliary discharge hole 712.

The present invention is not rigidly restricted to the embodiments described above. It is to be understood that a person skilled in the art can easily change and modify the present invention without departing from the scope of the invention defined in the appended claims.

What is claimed is:

1. A hermetically sealed electric motor compressor, comprising:

a hermetically sealed casing housing a reciprocating compressor unit having a discharge port for compressing a working fluid, a valve assembly for opening and closing said discharge port including a reed valve assembly comprising a reed valve and a valve backer mounted behind the reed valve, a valve seat with a recess including first and second recesses, said second recess receiving said reed valve assembly and said first recess corresponding to the figures of fulcrums of said reed valve, an elastic gasket having tongue shaped ribs, said reed valve and said valve backer being temporarily held within said recess of the valve seat by being pushed via the ribs of said gasket within said first recess and being subassembled as said reed valve assembly.

2. A hermetically sealed electric motor compressor according to claim 1, wherein the reed valve includes a fixed end including opposite fulcrums projecting laterally of the reed valve, an intermediate portion extending from the fixed end obliquely to a straight line joining the opposite fulcrums and an operating and adjoined to the front end of the intermediate portion opening and closing the discharge port, and the valve backer includes a fixed end having substantially the same shape as the fixed end of the reed valve, an intermediate portion extending from the fixed end of the valve backer in the same direction as the intermediate portion of the reed valve, a front end adjoined to the front end of the intermediate portion, said intermediate portion having a width narrower along the direction from the fixed end to the front end, said front end of the valve backer having the width narrower than the operating end of the reed valve.

3. A hermetically sealed electric motor compressor, according to claim 1 further comprising a discharge port unit mounted to the discharge side of the valve assembly, said discharge port unit including a muffler which comprises a plurality of resonance chambers and a passageway extending between the resonance chambers from a discharge port of the last one of the resonance chambers; the volumes of the resonance chambers sequentially decreasing as the positions of the resonance chambers depart from the discharge side of the valve assembly, and flow resistances of the passageways of the muffler sequentially increasing as the positions of the passageways of the muffler depart from the discharge port.

4. A hermetically sealed electric motor compressor, comprising:

a hermetically sealed casing housing a reciprocating compressor unit having a discharge port for compressing a working fluid, a valve assembly opening and closing said discharge port, a discharge port unit mounted to the discharge side of the valve assembly including a base plate having a projection, a reed valve assembly comprising a reed valve and a valve backer mounted behind the reed valve, said reed valve including a fixed end including opposite fulcrums projecting laterally of the reed valve, an intermediate portion extending from the fixed end obliquely to a straight line joining the opposite fulcrums and an operating end adjoined to the front end of the intermediate portion for opening and closing the discharge port, said valve backer including a fixed end having substantially the same shape as the fixed end of the reed valve, an intermediate portion extending from the fixed end of the valve backer in the same direction as the intermediate portion of the reed valve, a front end adjoined to the front end of the intermediate portion, said intermediate portion having a width narrower along the direction from the fixed end to the front end, and said front end of the valve backer having a width narrower than the operating end of the reed valve, a valve seat defining a recess receiving said reed valve assembly, and an elastic gasket, the end of the reed valve assembly being held in the valve seat recess by being pushed via the gasket against said projection of the base plate of the discharge port unit.

5. A hermetically sealed electric motor compressor, according to claim 4 further comprising a discharge port unit mounted to the discharge side of the valve assembly, said discharge port unit including a muffler which comprises a plurality of resonance chambers and a passageway extending between the resonance chambers from a discharge port of the last one of the resonance chambers; the volumes of the resonance chambers sequentially decreasing as the positions of the resonance chambers depart from the discharge side of the valve assembly, and flow resistance of the passageways of the muffler sequentially increasing as the positions of the passageways of the muffler depart from the discharge port.

* * * * *